US009392821B1

(12) United States Patent
Baker

(10) Patent No.: US 9,392,821 B1
(45) Date of Patent: Jul. 19, 2016

(54) MULTI-LAYER COSTUME BIB

(71) Applicant: JoAnn Baker, Salado, TX (US)

(72) Inventor: JoAnn Baker, Salado, TX (US)

( * ) Notice: Subject to any disclaimer, the term of this patent is extended or adjusted under 35 U.S.C. 154(b) by 355 days.

(21) Appl. No.: 14/212,828

(22) Filed: Mar. 14, 2014

(51) Int. Cl.
*A41B 13/10* (2006.01)
*A41D 13/04* (2006.01)

(52) U.S. Cl.
CPC ..... *A41B 13/10* (2013.01); *A41D 13/04* (2013.01); *A41B 13/103* (2013.01)

(58) Field of Classification Search
CPC ..... A41B 13/10; A41B 13/103; A41D 13/04
USPC ..... 2/46, 49.1, 49.2, 52, 48, 50, 49.4, 51
See application file for complete search history.

(56) References Cited

U.S. PATENT DOCUMENTS 4,569,086 A * 2/1986 Takefman ..... A41B 13/103 2/49.2
5,490,289 A * 2/1996 Lehrer ..... A41B 13/103 2/46
6,308,333 B1 * 10/2001 Jackson ..... A41B 13/10 2/49.1
7,237,271 B1 7/2007 McLandrich
7,269,857 B2 9/2007 Cymbol
8,166,571 B2 5/2012 Fletcher
2004/0128729 A1 * 7/2004 Lat ..... A41B 13/103 2/46
2007/0143904 A1 * 6/2007 Brown ..... A41B 13/103 2/49.1
2012/0174279 A1 * 7/2012 Bailey ..... A41B 13/103 2/48

* cited by examiner

*Primary Examiner* — Katherine Moran
(74) *Attorney, Agent, or Firm* — Crossley & Stevenson Intellectual Property Law

(57) ABSTRACT

A multi-layer costume bib including a bib body with a pocket for catching crumbs, a detachable retention strap for a youth or an adult wearer who lacks sufficient mobility to don the bib otherwise, and a waterproof medial layer disposed between an external layer and an internal layer in each of the bib body and the pocket, as well as an interfacing between the medial layer and the external layer of the pocket. The present costume bib also provides first and second members that are costume elements to encourage a youth or an adult to wear the bib and to encourage the wearer to participate in entertainment activities.

10 Claims, 6 Drawing Sheets

MULTI-LAYER COSTUME BIB

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of garment protectors are known in the prior art. However, what is needed is a multi-layer costume bib including a bib body with a pocket for catching crumbs, a detachable retention strap for an wears who lacks sufficient mobility to don the bib otherwise, and a waterproof medial layer disposed between an external layer and an internal layer in each of the bib body and the pocket, as well as an interfacing between the medial layer and the external layer of the pocket. The present costume bib also provides first and second members that are costume elements to encourage both youths and adults to wear the bib and to encourage the wearer to participate in entertainment activities.

FIELD OF THE INVENTION

The present invention relates to garment protectors, and more particularly, to a multi-layer costume bib.

SUMMARY OF THE INVENTION

The general purpose of the present multi-layer costume bib, described subsequently in greater detail, is to provide a multi-layer costume bib which has many novel features that result in a multi-layer costume bib which is not anticipated, rendered obvious, suggested, or even implied by prior art, either alone or in combination thereof.

To accomplish this, the present multi-layer costume bib includes a monolithic primary bib body. The primary bib body is configured to cover a front upper torso of a wearer extending from the wearer's neck to the wearer's waist. The bib body includes a bottom end, a neck end spaced apart from the bottom end, a right side, and a left side. The bottom end is wider than the neck end to protect the sides and lap of a wearer. A gradual concave taper is disposed along each of the right side and the left side between the bottom end and the neck end to generally conform to a wearer's front upper torso and to allow for a comfortable fit around the wearer's arms. A retention strap is disposed on the neck end and has an inner end and an outer end. Releasably attachable portions of a hook and loop fastener are attached to each of a respective one of the right side and the left side on the neck end opposite the inner end and also on the outer end of the retention strap to permit the wearer who lacks sufficient mobility to don the bib body. A monolithic L-shaped pocket is provided to catch food crumbs that are dropped by the wearer.

Each of the entire primary bib body and the entire pocket further include a continuous internal layer, a continuous external layer, and a continuous medial layer disposed between the internal layer and the external layer. The medial layer is waterproof to protect a garment being worn by a wearer from spills. Each of the internal layer and the external layer is a washable cotton-polyester blend fabric. A fusible interfacing is continuously disposed between the medial layer of only the pocket and the external layer of only the pocket. The interfacing strengthens the pocket.

At least one first member is fixedly disposed and alternately is removably disposed on the external layer and a plurality of second members disposed on the bib body are costume elements provided to encourage use by a youth or an adult wearer and to encourage the wearer to engage in entertaining activities. At least one fastener is disposed on the bib body proximal the neck end. The fastener is centrally disposed on the bib body and alternately disposed on the neck end on one of the right side and the left side opposite the hook and loop fastener first portion and second portion. The fastener permits the attachment of the bowtie to the bib body and alternately permits the attachment of the outer end of the retention strap to the bib body.

Thus has been broadly outlined the more important features of the present multi-layer costume bib so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
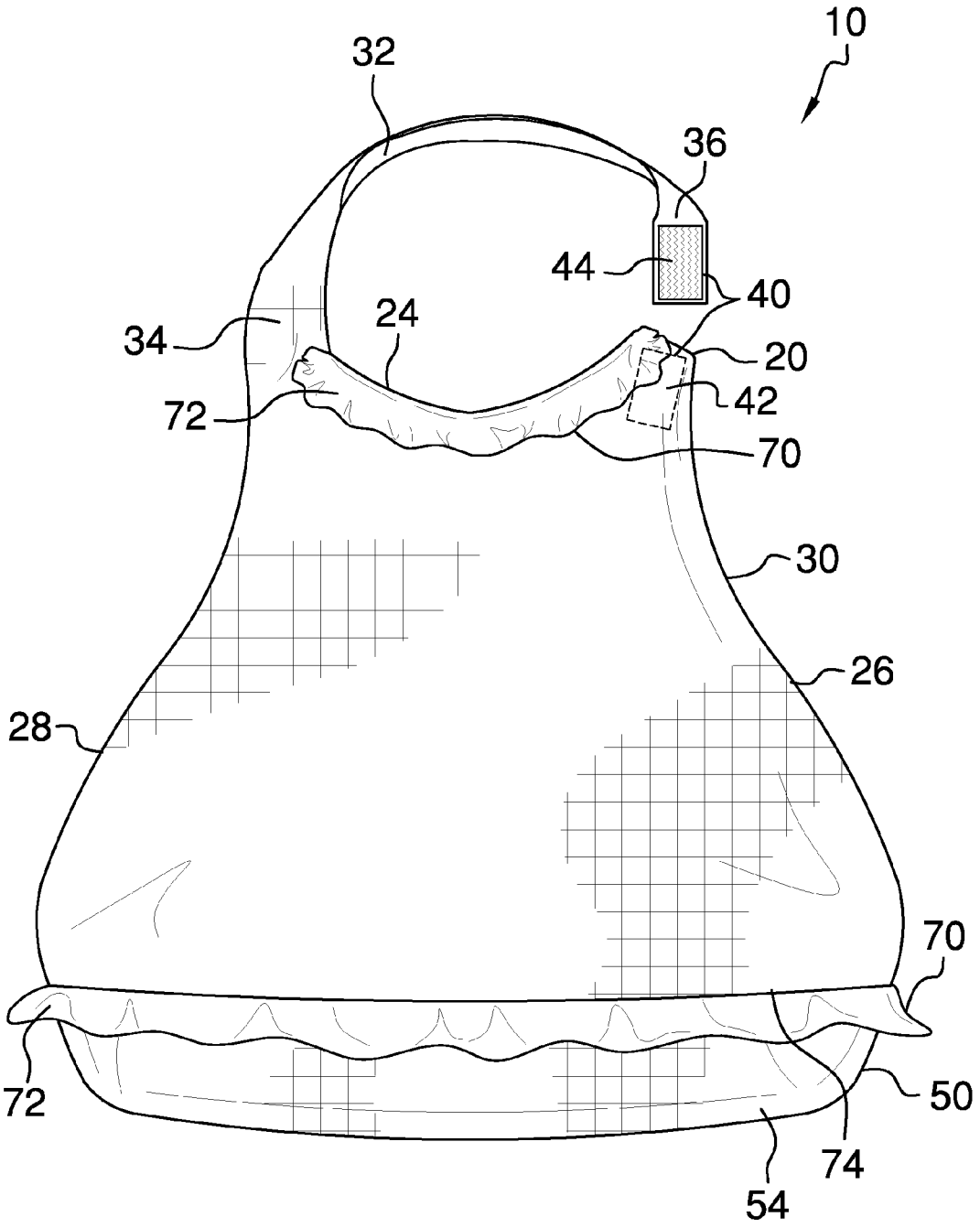
FIG. 1 is a front elevation view showing a first costume design.
Figure 2:
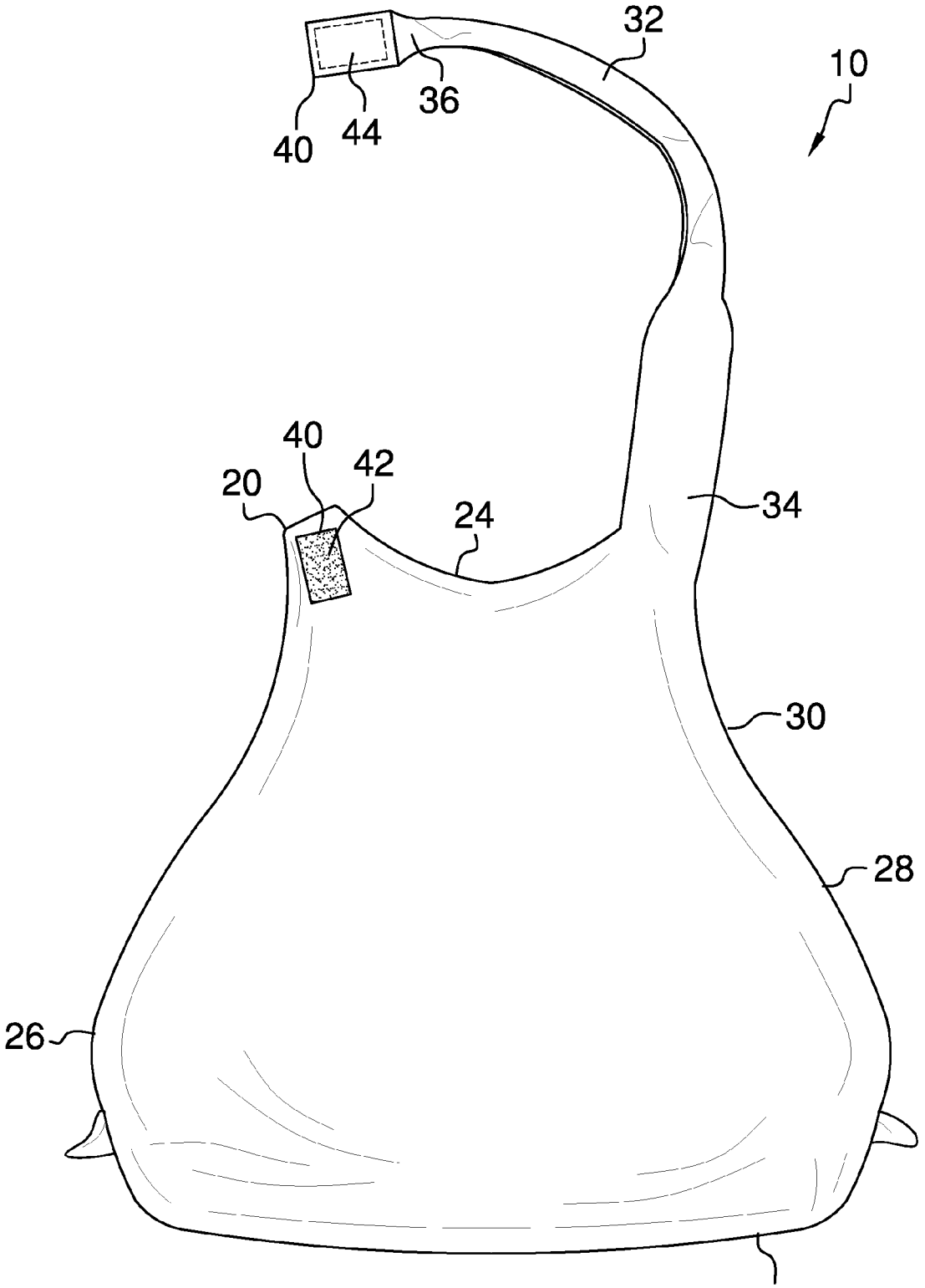
FIG. 2 is a rear elevation view.
Figure 3:
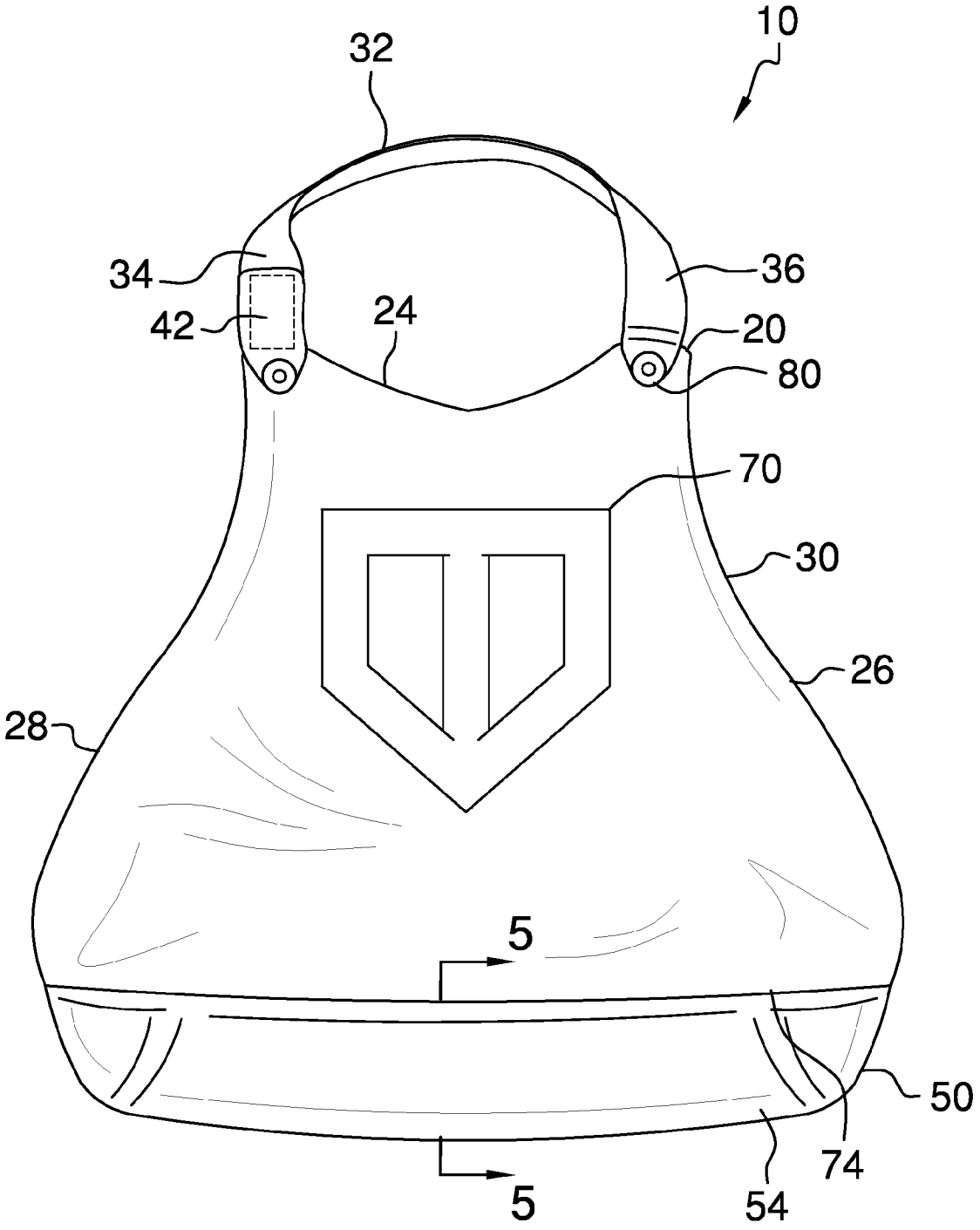
FIG. 3 is a front elevation view showing a second costume design.
Figure 4:
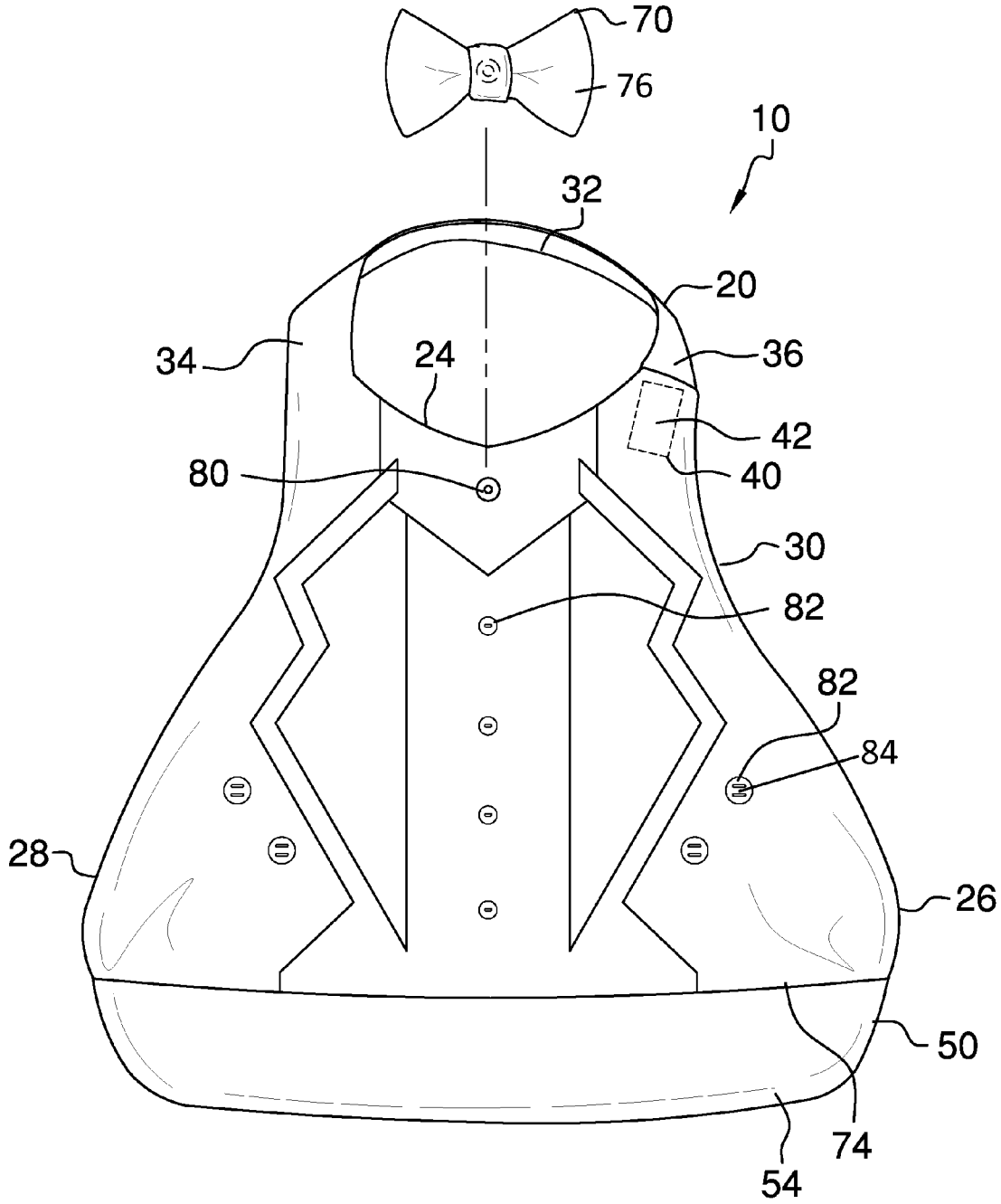
FIG. 4 is a front elevation view showing a third costume design.
Figure 5:
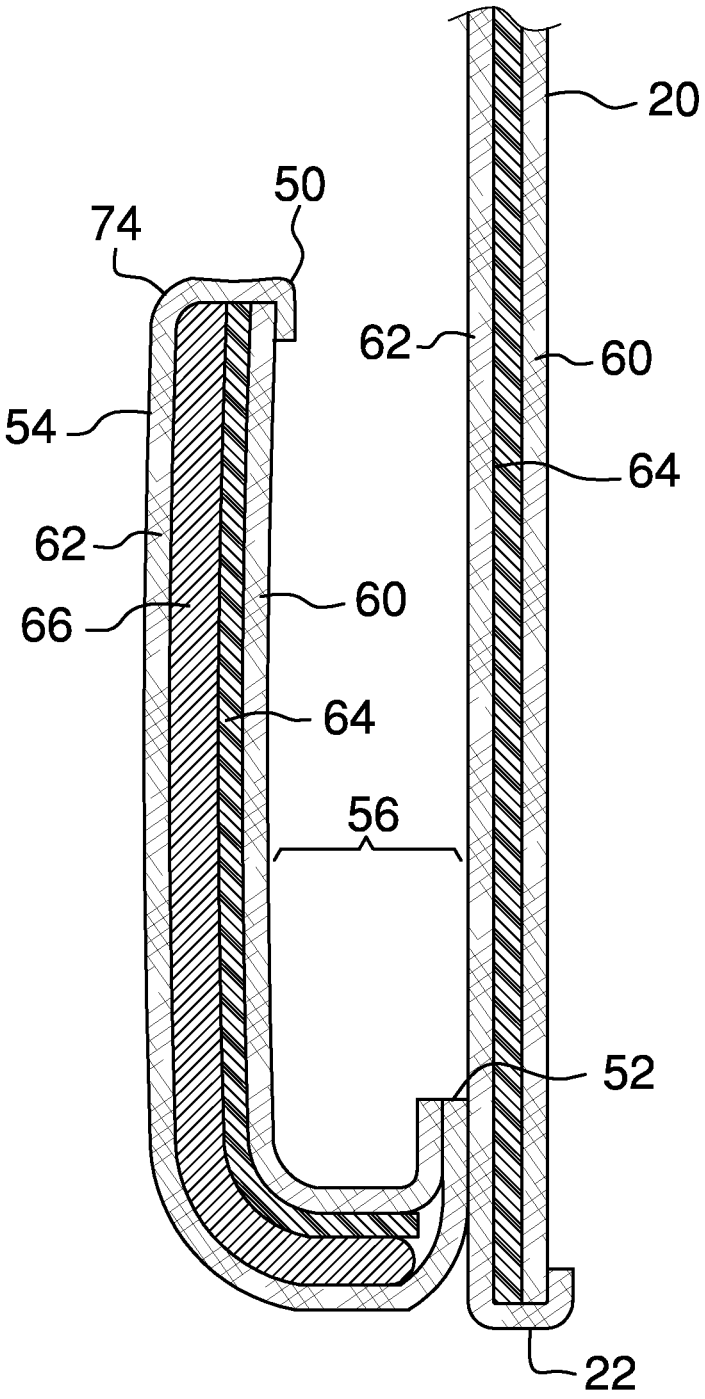
FIG. 5 is a cross-sectional view taken along line 5-5 of FIG. 3.
Figure 6:
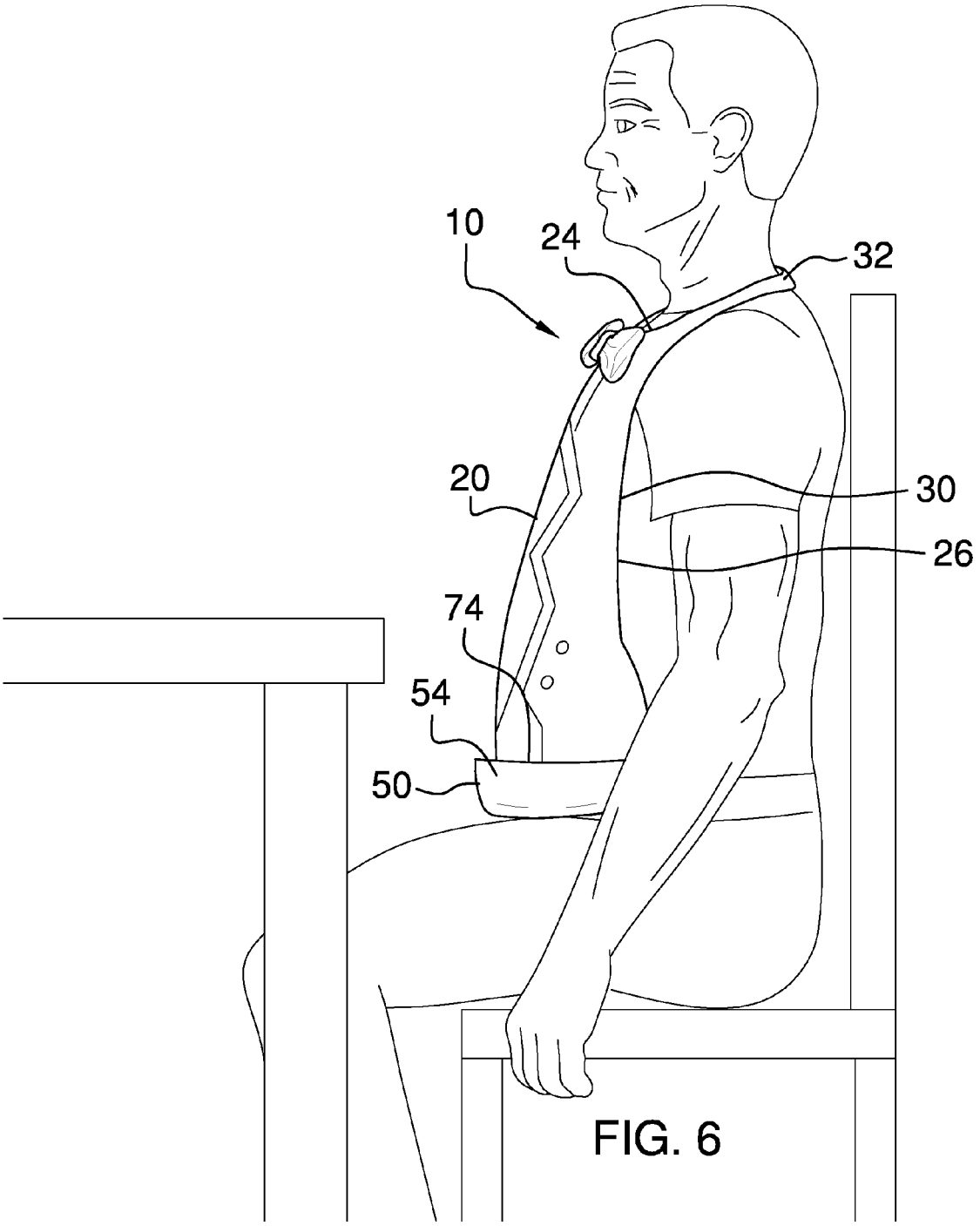
FIG. 6 is an in-use view.

With reference now to the drawings, and in particular FIGS. 1 through 6 thereof, an example of the instant multi-layer costume bib employing the principles and concepts of the present multi-layer costume bib and generally designated by the reference number 10 will be described.

Referring to FIGS. 1 through 6 the present multi-layer costume bib 10 is illustrated. The multi-layer costume bib 10 includes a monolithic primary bib body 20. The primary bib body 20 is configured to cover a front upper torso of a wearer extending from the wearer's neck to the wearer's waist. The bib body 20 includes a bottom end 22, a neck end 24 spaced apart from the bottom end 22, a right side 26, and a left side 28. The neck end 24 has a width narrower than a width of the bottom end 22. The bottom end 22 is wider to protect the sides and lap of a wearer. A gradual concave taper 30 is disposed along each of the right side 26 and the left side 28 between the bottom end 22 and the neck end 24 to generally conform to a wearer's front upper torso and to allow for a comfortable fit around the wearer's arms. A retention strap 32 is disposed on the neck end 24. The retention strap 32 has an inner end 34 secured to one of the right side 26 and the left side 28 and an outer end 36. A hook and loop fastener 40, having a first portion 42 and a second portion 44, is attached to each of a respective one of the right side 26 and the left side 28 on the neck end 24 opposite the inner end 34 of the retention strap 32 and also on the outer end 36 of the retention strap 32. The first portion 42 and the second portion 44 releasably attach to each other. The retention strap 32 is detachable to permit the wearer who lacks sufficient mobility to don the bib body 20.

A monolithic L-shaped pocket 50 is provided to catch food crumbs that are dropped by the wearer. The pocket 50 has an interior wall 52 continuously attached to the entire bottom end 22 of the bib body 20 and an exterior wall 54. The exterior wall 54 has a height longer than a height of the interior wall 52. The exterior wall 54 height is at least twice as long as the interior wall 52 height.

Each of the entire primary bib body 20 and the entire pocket 50 further include a continuous internal layer 60, a continuous external layer 62, and a continuous medial layer 64 disposed between the internal layer 60 and the external layer 62. The medial layer 64 is waterproof to protect a garment being worn by a wearer from spills. Each of the internal layer 60 and the external layer 62 is a washable cotton-polyester blend fabric. A fusible interfacing 66 is continuously disposed between the medial layer 64 of only the pocket 50 and the external layer 62 of only the pocket 50. A channel 56 is disposed between the pocket 50 internal layer 60 and the bib body 20 for catching the food crumbs.

At least one first member 70 is fixedly disposed and alternately is removably disposed on the external layer 62. The first member 70 is a costume element which is provided to encourage use by a youth or an adult wearer and to encourage the wearer to engage in entertaining activities. The first member 70 is one of a length of gathered fabric 72 fixedly disposed on each of an upper edge of the neck end 24 and along an entire upper edge 74 of the pocket 50 exterior wall 54, a bowtie 76 centrally disposed on the neck end 24; and an emblem 78 centrally disposed on the bib body external layer.

At least one fastener 80 is disposed on the bib body 20 proximal the neck end 24. The fastener 80 is centrally disposed on the bib body 20 and alternately disposed on the neck end 24 on one of the right side 26 and the left side 27 opposite the hook and loop fastener 40 first portion 42 and second portion 44. The fastener 80 permits the attachment of the bowtie 76 to the bib body 20 and alternately permits the attachment of the outer end 36 of the retention strap 32 to the bib body 20.

A plurality of second members 82, which is configured to also provide a costume element, is also provided. The second members 82 preferably comprise a plurality of buttons 84 and are disposed in a configuration along with the bowtie 76 in a configuration to resemble a tuxedo.

What is claimed is:

1. A multi-layer costume bib comprising:

a monolithic primary bib body, wherein the primary bib body is configured to cover a front upper torso of a wearer extending from the wearer's neck to the wearer's waist, the bib body comprising:

a bottom end;

a neck end spaced apart from the bottom end, the neck end having a width narrower than a width of the bottom end;

a right side;

a left side;

a gradual concave taper disposed along each of the right side and the left side between the bottom end and the neck end;

a retention strap disposed on the neck end, the retention strap having an inner end secured to one of the right side and the left side and an outer end;

a hook and loop fastener having a first portion and a second portion attached to each of a respective one of the right side and the left side on the neck end opposite the inner end of the retention strap and the outer end of the retention strap, wherein the first portion and the second portion releasably attach to each other;

a monolithic L-shaped pocket having an interior wall continuously attached to the entire bottom end of the bib body and an exterior wall, wherein the exterior wall has a height longer than a height of the interior wall;

a channel disposed between the pocket and the bib body;

wherein each of the entire primary bib body and the entire pocket further comprise:

a continuous internal layer;

a continuous external layer; and a continuous medial layer disposed between the internal layer and the external layer;

wherein the medial layer is waterproof;

at least one first member fixedly disposed and alternately removably disposed on the external layer, wherein the first member is a costume element.

2. The multi-layer costume bib of claim 1 wherein each of the internal layer and the external layer is a washable cotton-polyester blend fabric.

3. The multi-layer costume bib of claim 1 wherein the pocket further comprises an interfacing continuously disposed between the medial layer and the external layer.

4. The multi-layer costume bib of claim 1 further comprising at least one fastener disposed on the bib body proximal the neck end, wherein the fastener is centrally disposed on the bib body and alternately disposed on the neck end on one of the right side and the left side opposite the hook and loop fastener first portion and second portion.

5. The multi-layer costume bib of claim 2 wherein the pocket further comprises an interfacing continuously disposed between the medial layer and the external layer.

6. The multi-layer costume bib of claim 3 wherein the interfacing is fusible.

7. The multi-layer costume bib of claim 4 wherein the pocket further comprises an interfacing continuously disposed between the medial layer and the external layer.

8. A multi-layer costume bib comprising:

a monolithic primary bib body, wherein the primary bib body is configured to cover a front upper torso of a wearer extending from the wearer's neck to the wearer's waist, the bib body comprising:

a bottom end;

a neck end spaced apart from the bottom end, the neck end having a width narrower than a width of the bottom end;

a right side;

a left side;

a gradual concave taper disposed along each of the right side and the left side between the bottom end and the neck end;

a retention strap disposed on the neck end, the retention strap having an inner end secured to one of the right side and the left side and an outer end;

a hook and loop fastener having a first portion and a second portion attached to each of a respective one of the right side and the left side on the neck end opposite the inner end of the retention strap and the outer end of the retention strap, wherein the first portion and the second portion releasably attach to each other;

a monolithic L-shaped pocket having an interior wall continuously attached to the entire bottom end of the bib body and an exterior wall, wherein the exterior wall has a height at least twice a height of the interior wall;

a channel disposed between the pocket internal layer and the bib body;

wherein each of the entire primary bib body and the entire pocket further comprise:

a continuous internal layer;

a continuous external layer; and a continuous medial layer disposed between the internal layer and the external layer;

wherein the medial layer is waterproof;

wherein each of the internal layer and the external layer is a washable cotton-polyester blend fabric;

a fusible interfacing continuously disposed between the medial layer of only the pocket and the external layer of only the pocket;

at least one first member fixedly disposed and alternately removably disposed on the external layer, wherein the first member is a costume element, at least one fastener disposed on the bib body proximal the neck end, wherein the fastener is centrally disposed on the bib body and alternately disposed on the neck end on one of the right side and the left side opposite the hook and loop fastener first portion and second portion.

9. The multi-layer costume bib of claim 8 wherein the first member is one of a length of gathered fabric fixedly disposed on each of an upper edge of the neck end and along an entire upper edge of the pocket exterior wall, a bowtie centrally disposed on the neck end; and an emblem centrally disposed on the bib body external layer.

10. The multi-layer costume bib of claim 9 further comprising a plurality of second members, the second members configured to provide a costume element;

wherein the second members comprise a plurality of buttons;

wherein the buttons and the bowtie are disposed in a configuration to resemble a tuxedo.

* * * * *